US007572156B2

(12) United States Patent
Schroll et al.

(10) Patent No.: US 7,572,156 B2
(45) Date of Patent: Aug. 11, 2009

(54) APPARATUS FOR STABILIZING AND SECURING CONTACT MODULES WITHIN AN ELECTRICAL CONNECTOR ASSEMBLY

(75) Inventors: Neil Franklin Schroll, Mount Joy, PA (US); Samuel Joseph Magaro, Jr., Oberlin, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/874,020

(22) Filed: Oct. 17, 2007

(65) Prior Publication Data

US 2009/0104812 A1 Apr. 23, 2009

(51) Int. Cl.
*H01R 9/22* (2006.01)

(52) U.S. Cl. ..... 439/717

(58) Field of Classification Search ..... 439/717
See application file for complete search history.

(56) References Cited

U.S. PATENT DOCUMENTS

| | | | | |
|---|---|---|---|---|
| 5,795,191 | A | 8/1998 | Preputnick et al. | |
| 6,146,202 | A | 11/2000 | Ramey et al. | |
| 6,322,399 | B1 * | 11/2001 | Hanning | 439/717 |
| 6,386,924 | B2 | 5/2002 | Long | |
| 6,743,057 | B2 | 6/2004 | Davis et al. | |
| 7,326,082 | B2 * | 2/2008 | Sharf | 439/608 |

* cited by examiner

*Primary Examiner*—Ross N Gushi

(57) ABSTRACT

A contact module is provided. The contact module is configured to be held by a housing of an electrical connector adjacent two other contact modules. The contact module includes at least one electrical lead, and a body holding at least a portion of the at least one electrical lead. The body has opposite first and second side portions. The first side portion includes a first extension. The second side portion includes a first slot. The first extension is configured to be received within a second slot of a first of the two other contact modules. The first slot is configured to receive a second extension of a second of the two other contact modules.

21 Claims, 5 Drawing Sheets

APPARATUS FOR STABILIZING AND SECURING CONTACT MODULES WITHIN AN ELECTRICAL CONNECTOR ASSEMBLY

BACKGROUND OF THE INVENTION

This invention relates generally to electrical connectors, and more particularly, to electrical connectors having an apparatus for stabilizing and securing a plurality of contact modules within a housing.

It is common, in the electronics industry, to use right angled connectors for electrical connection between two printed circuit boards or between a printed circuit board and another electrical component. At least some right angle connectors include a plurality of contact modules that are received in a housing. Each contact module typically includes a plurality of electrical mating contacts on a mating edge of the contact module and a plurality of electrical mounting contacts on a mounting edge of the contact module for electrically connecting the printed circuit boards or the printed circuit board and the other electrical component. However, the contact modules of some known electrical connectors are not completely constrained within the housing and therefore may move with respect to the housing. Movement of contact modules with respect to the housing may cause instability and/or buckling as the electrical connector is mounted on the printed circuit board. Moreover, movement of contact modules with respect to the housing during mounting of the electrical connector on the printed circuit board may cause misalignment of features of the electrical connector that facilitate retaining the electrical connector on the printed circuit board, such as, but not limited to, electrical contacts and the corresponding vias or sockets.

At least some known electrical connectors include an additional organizing component that interconnects to the contact modules to restrain movement of the contact modules within the housing. However, the additional organizing component increases the cost and complexity of the electrical connector. The additional organizing component also requires additional manufacturing processes to fabricate the organizer and install the organizer on the contact modules.

There is a need for a lower cost and more easily manufactured electrical connector having contact modules that are at least partially restrained from movement with respect to a housing.

BRIEF DESCRIPTION OF THE INVENTION

In one embodiment, a contact module is provided. The contact module is configured to be held by a housing of an electrical connector adjacent two other contact modules. The contact module includes at least one electrical lead, and a body holding at least a portion of the at least one electrical lead. The body has opposite first and second side portions. The first side portion includes a first extension. The second side portion includes a first slot. The first extension is configured to be received within a second slot of a first of the two other contact modules. The first slot is configured to receive a second extension of a second of the two other contact modules.

In another embodiment, an electrical connector is provided. The electrical connector includes a housing and a plurality of contact modules held by the housing. Each of the contact modules includes at least one electrical lead. Each of the contact modules includes a body holding at least a portion of the at least one electrical lead. The body includes a slot and an extension. The extension of at least one contact module body is received within the slot of an adjacent contact module body.

In another embodiment, a contact module assembly is provided. The contact module assembly includes a plurality of contact modules each including at least one electrical lead and a body holding at least a portion of the at least one electrical lead. The body of each of the contact modules includes a pair of opposite side portions that each face a corresponding adjacent other contact module of the plurality of contact modules. The plurality of contact modules each include lock elements that are located along the side portions of the body and are positioned to interlock with the lock elements of adjacent contact modules. The lock elements are each formed integrally with the body of the corresponding contact module.

DETAILED DESCRIPTION OF THE INVENTION

Figure 1:
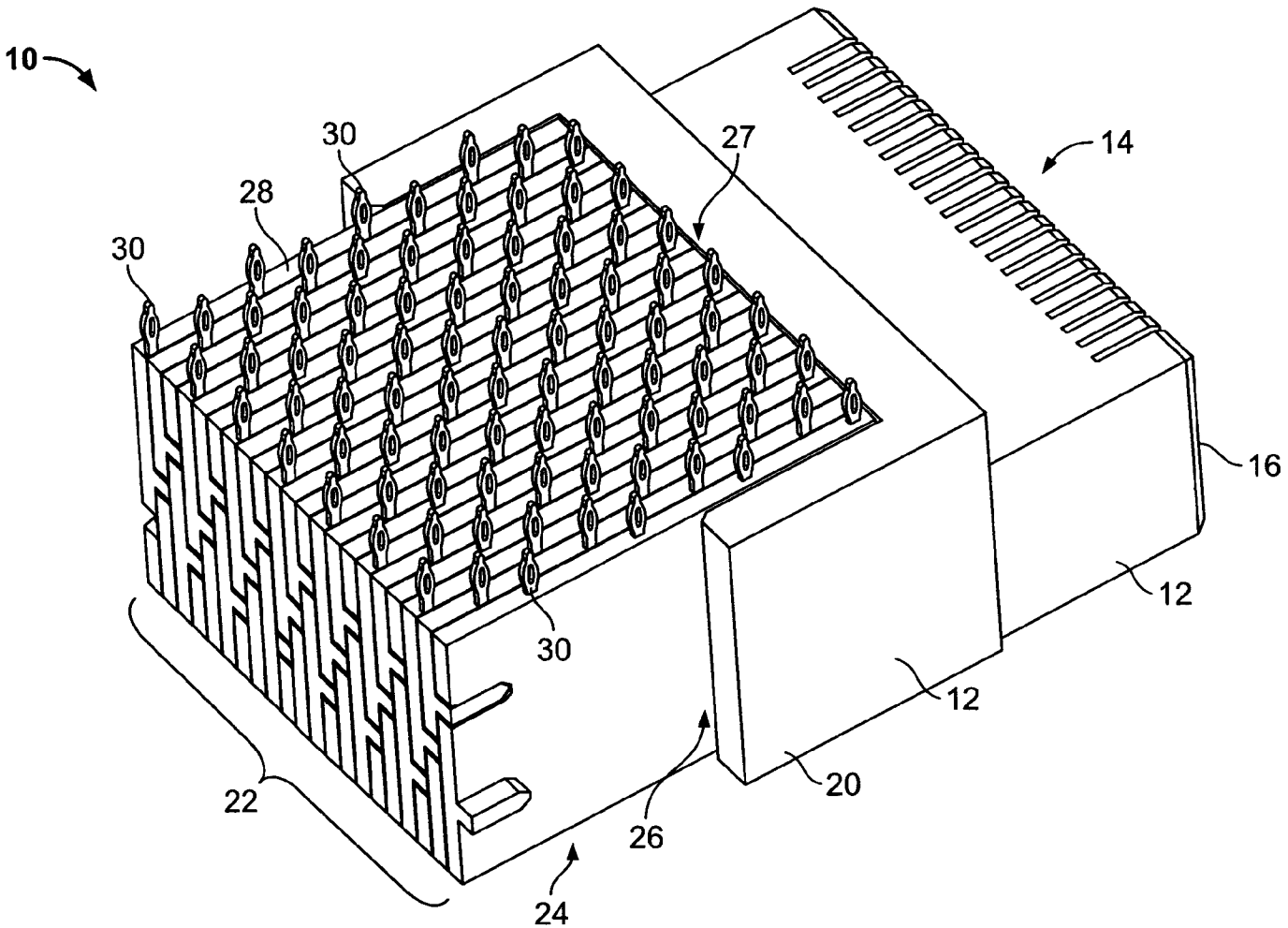
FIG. 1 is a perspective view of an exemplary embodiment of an electrical connector.
Figure 2:
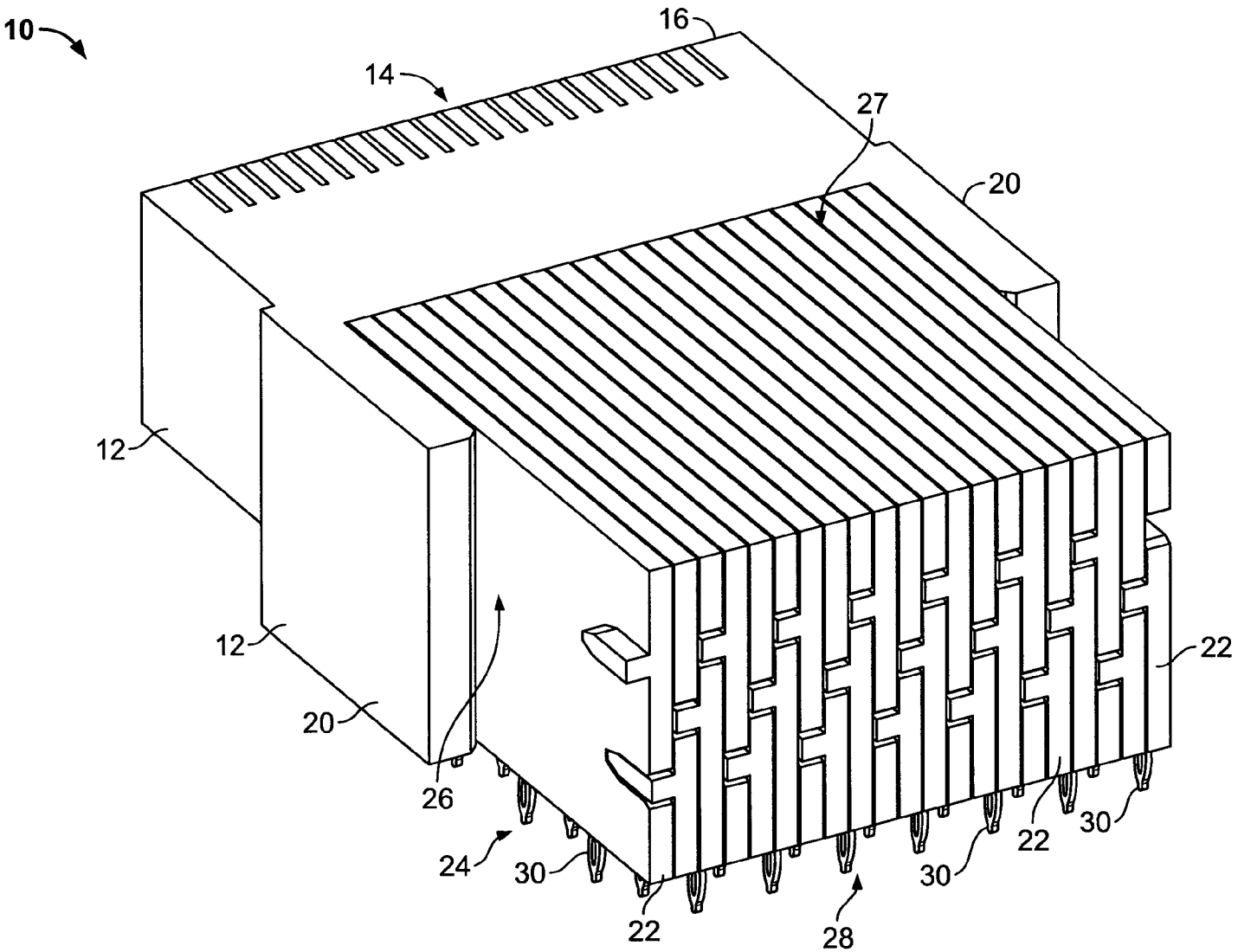
FIG. 2 is another perspective view of the electrical connector shown in FIG. 1.

FIGS. 1 and 2 illustrate an exemplary embodiment of an electrical connector 10. While the connector 10 will be described with particular reference to a receptacle connector, it is to be understood that the benefits herein described are also applicable to other connectors in alternative embodiments. The following description is therefore provided for purposes of illustration, rather than limitation, and is but one potential application of the inventive concepts herein.

The connector 10 includes a housing 12 having a forward mating end portion 14 that includes a mating face 16. The housing 12 may optionally be dielectric. The mating face 16 includes a plurality of mating contacts 18 (FIGS. 3-5), such as, for example, contacts within contact cavities (not shown) within the mating face 16 that are configured to receive corresponding mating contacts (not shown) from, for example, a circuit board (not shown) or a mating connector (not shown). The housing 12 also includes a rearwardly extending hood 20. A plurality of contact modules 22 are received in the housing 12 from a rearward end portion 24 of the housing 12. Specifically, the hood 20 defines a chamber 26. The chamber 26 receives a forward end portion 27 of each of the contact modules 22. The contact modules 22 define a connector mounting face 28. The connector mounting face 28 includes a plurality of contacts 30, such as, but not limited to, pin contacts, or more particularly, eye-of-the-needle-type contacts, that are configured to be mounted to a substrate (not shown), such as, but not limited to, a circuit board. The plurality of contacts 30 may be referred to herein as mounting contacts. In an exemplary embodiment, the mounting face 28 is substantially perpendicular to the mating face 16 such that the connector 10 interconnects electrical components that are substantially at a right angle to one another. As will be described in more detail below, the contact modules 22 are interlocked with one another to facilitate stabilizing and securing the contact modules 22 within the housing 12.

Figure 3:
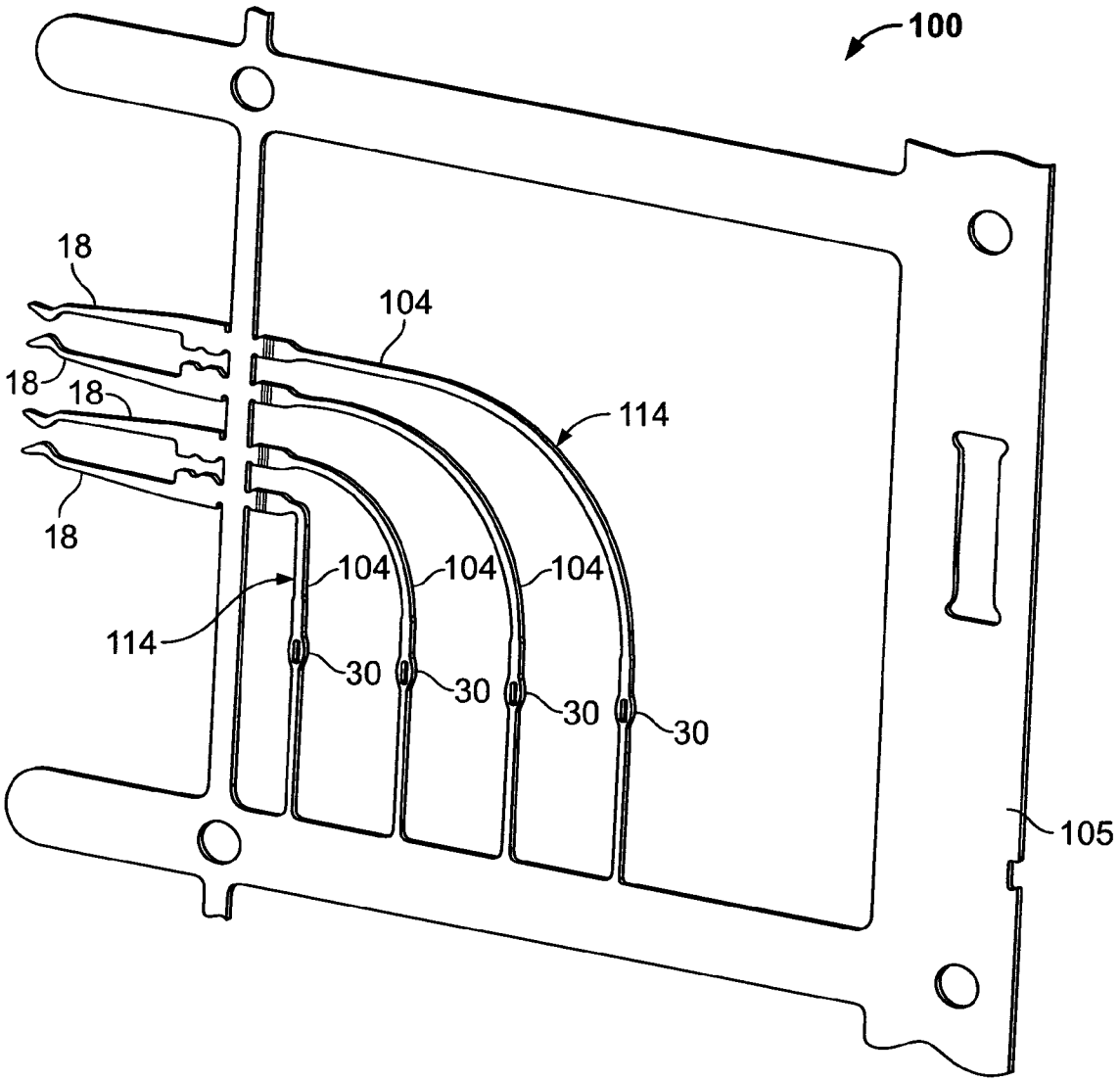
FIG. 3 is a perspective view of an exemplary embodiment of a lead frame that is used to form a contact module that may be used with the electrical connector shown in FIG. 1.

FIG. 3 is a perspective view of an exemplary embodiment of a lead frame 100 that is used to form a contact module 22*a* (shown in FIGS. 4-6) that may be used with the electrical connector 10 (FIGS. 1 and 2). The lead frame 100 includes a plurality of leads 104 that extend along predetermined paths to electrically connect each mating contact 18 to a corresponding mounting contact 30. The leads 104 include the mating and mounting contacts 18 and 30, respectively, and an intermediate lead portion 114, which extends between the mating and mounting contacts 18 and 30, respectively. As shown in FIG. 3, prior to using the lead frame 100 to form the contact module 22*a*, the leads 104 are stabilized by a carrier strip 105.

Figure 4:
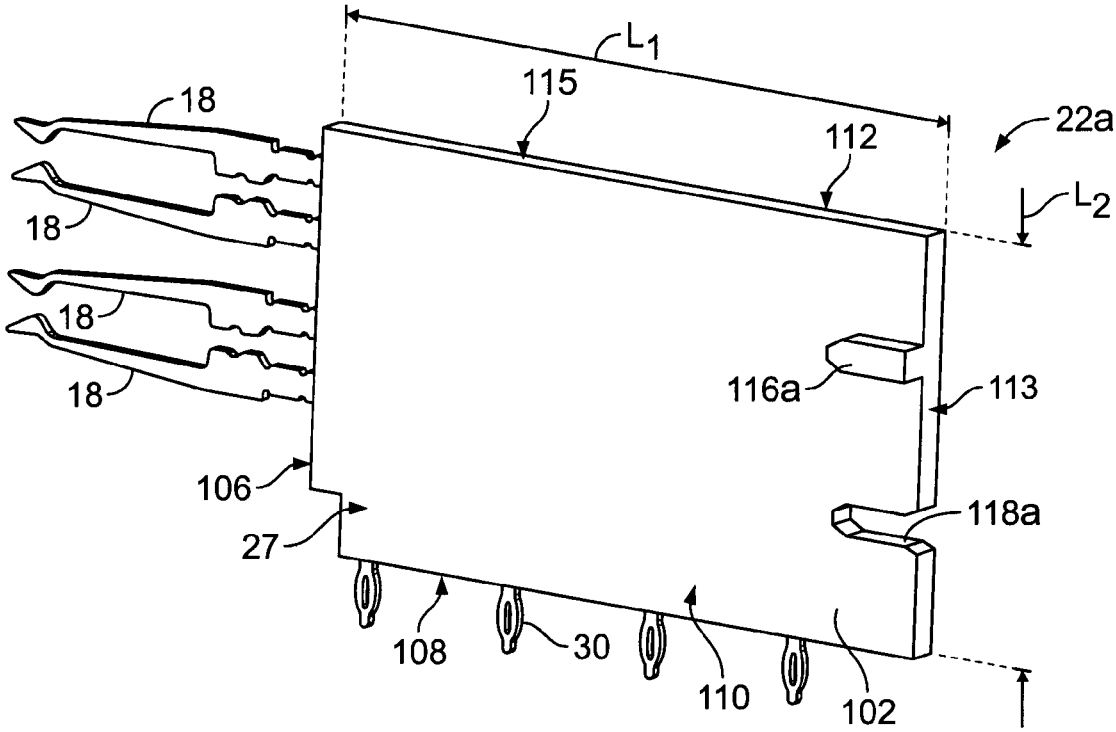
FIG. 4 is a perspective view of an exemplary embodiment of a contact module formed using the lead frame shown in FIG. 3.
Figure 5:
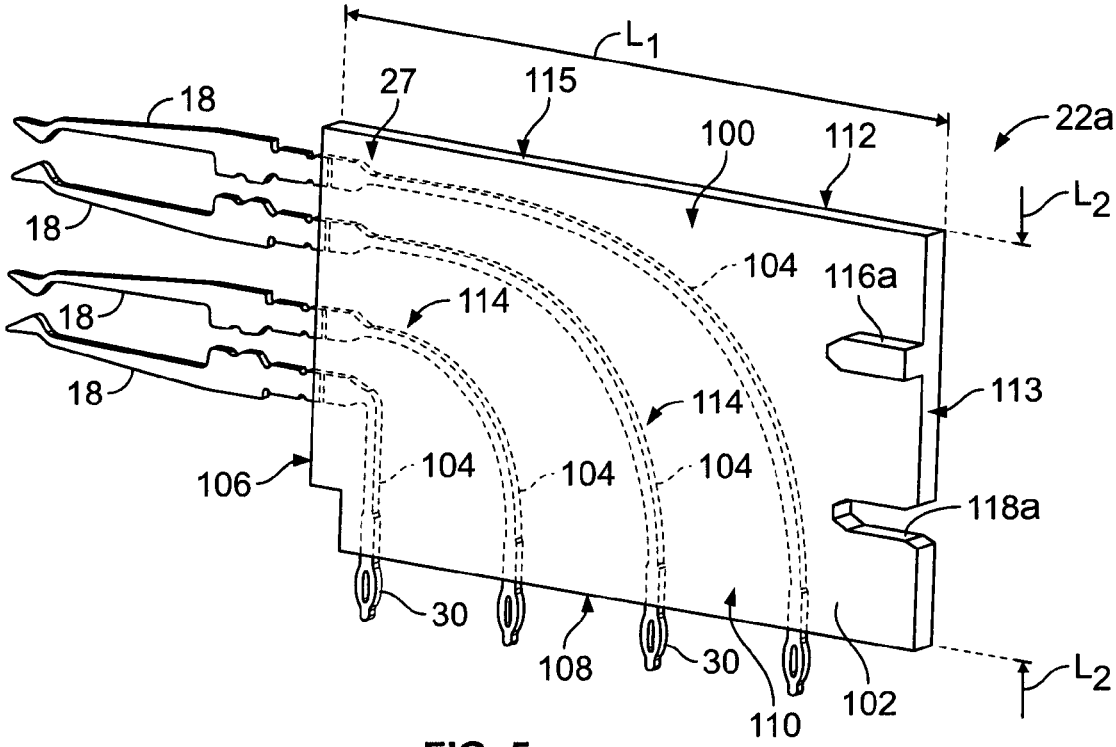
FIG. 5 is another perspective view of the contact module shown in FIG. 4.

FIGS. 4 and 5 illustrate an exemplary embodiment of the contact module 22*a*. The contact module 22*a* includes a body 102. The mating contacts 18 extend from a mating edge portion 106 of the body 102, and the mounting contacts 30 extend from a mounting edge portion 108 of the body 102. The forward end portion 27 of the contact module 22*a* includes the mating edge portion 106 of the body 102. The body 102 includes opposite side portions 110 and 112 that extend substantially parallel to and along the lead frame 100. When the contact module 22*a* is held by the housing 12 (FIGS. 1 and 2), the side portions 110 and 112 may each face another corresponding contact module 22 that is held by the housing 12 adjacent the contact module 22*a*. The body 102 extends a length $L_1$ between the mating edge portion 106 and an edge portion 113, and extends a length $L_2$ between an edge portion 115 and the mounting edge portion 108. In some embodiments, the body 102 is manufactured using an over-molding process. During the molding process, a portion of each of the leads 104 is encased in a material that forms the body 102. As can be seen from FIGS. 4 and 5, the carrier strip 105 (FIG. 3) is removed and discarded after the over-molding process that creates the body 102. In the exemplary embodiment, the mating and mounting edge portions 106 and 108, respectively, extend substantially perpendicular to each other. However, the mating and mounting edge portions 106 and 108, respectively, may extend any direction relative to each other, such as, but not limited to, substantially parallel.

In alternative embodiments, at least a portion of the intermediate lead portion 114 of one or more leads 104 may be removed such that the intermediate lead portion 114 of such a lead(s) 104 does not connect the mating and mounting contacts 18 and 30, respectively, of the lead(s) 104. In such an embodiment wherein a portion of one or more of the leads 104 is removed, a commoning member (not shown) may be employed to electrically connect the corresponding mating and mounting contacts 18 and 30, respectively.

Figure 6:
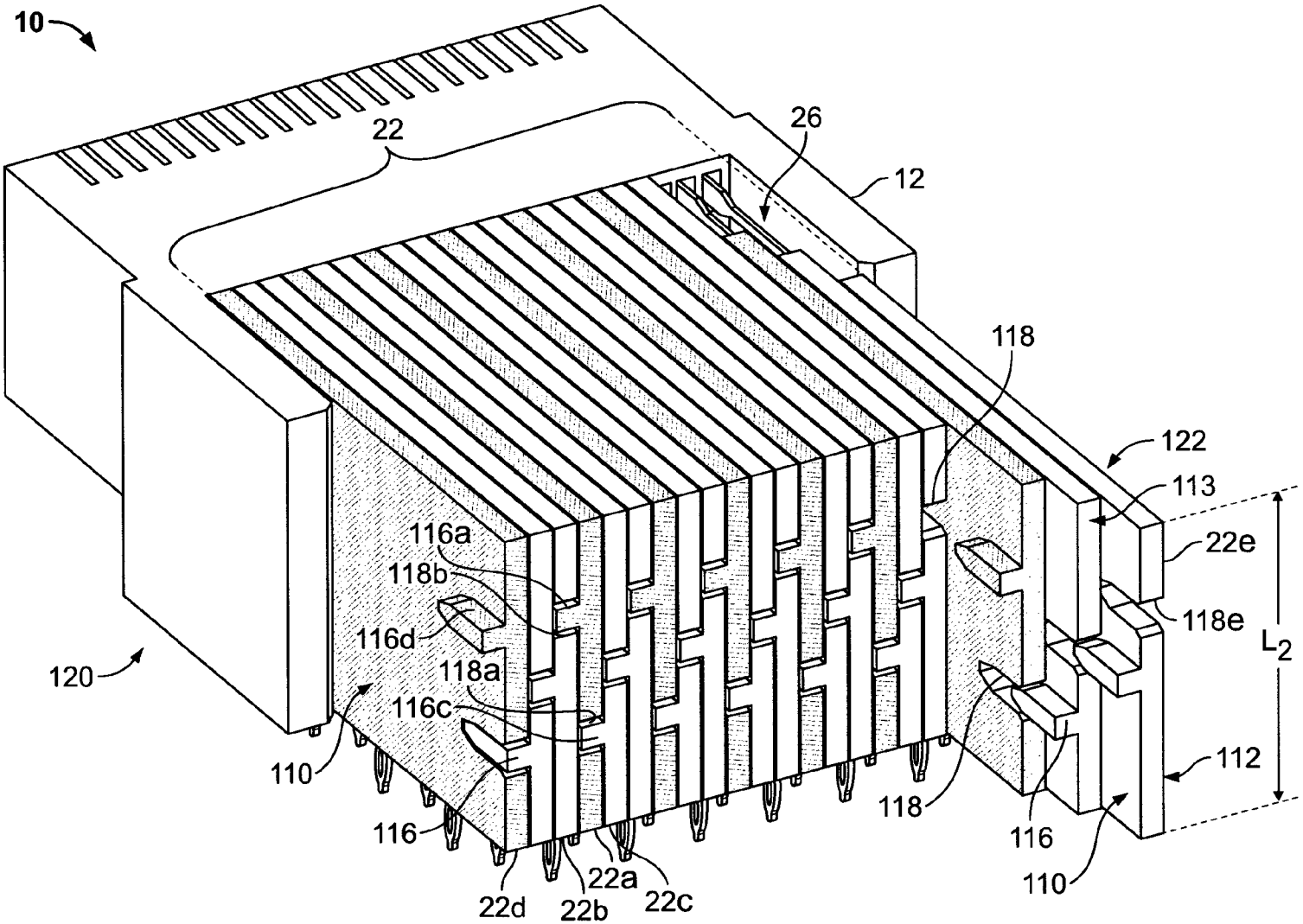
FIG. 6 is a partially exploded perspective view of the electrical connector shown in FIGS. 1 and 2.

In the exemplary embodiment, the leads 104 of the contact module 22*a* are each ground leads and the leads (not shown) of adjacent contact modules 22*b* and 22*c* (FIG. 6) of the connector 10 (FIGS. 1, 2, and 6) are each signal leads. As shown in FIG. 6, ground contact modules 22 are shown as shaded and signal contact modules 22 are not shaded. However, each of the leads 104 of each of the contact modules 22 held by the housing 12 (FIGS. 1, 2, and 6) may be a signal lead, a ground lead, or a power lead. Each contact module 22 held by the housing 12 may include any number of leads 104, any number of which may be selected as signal leads, ground leads, or power leads according the desired wiring pattern of the contact module 22. Optionally, adjacent signal leads may function as differential pairs, and each differential pair may optionally be separated by a ground lead.

Referring again to FIGS. 4 and 5, the contact module body 102 includes an extension 116*a* and a slot 118*a*. The extension 116*a* may optionally be formed integrally with the body 102 or may alternatively be formed separately from the body 102 and thereafter attached thereto. The extension 116*a* and the slot 118*a* facilitate interlocking the contact module 22*a* with adjacent contact modules 22 (FIGS. 1, 2, and 6) held by the housing 12 (FIGS. 1, 2, and 6). Specifically, in the exemplary embodiment, the extension 116*a* extends outwardly from the side portion 110 of the body 102 and the slot 118*a* extends completely through the body 102 from the side portion 112 to the side portion 110. As will be described in more detail below, the extension 116*a* cooperates with the slot 118*b* (FIG. 6) of another contact module 22*b* (FIG. 6) held by the housing 12 adjacent the side portion 110 of the contact module 22*a*, and the slot 118*a* cooperates with the extension 116*c* (FIG. 6) of another contact module 22*c* (FIG. 6) held by the housing 12 adjacent the side portion 112. The extension 116*a* and slot 118*a* thereby form lock elements that are located along the side portions 110 and 112, respectively, and are positioned to interlock with the lock elements (i.e., the slots 118 and extensions 116, respectively) of adjacent contact modules 22.

The extension 116*a* of the contact module 22*a* is sized and shaped complementary to the slot 118*b* of the contact module 22*b* that is held by the housing 12 adjacent the side portion 110 such that the extension 116*a* is sized and shaped to be received by the slot 118*b*. Similarly, the slot 118*a* of the contact module 22*a* is sized and shaped complementary to the extension 116*c* of the contact module 22*c* that is held by the housing 12 adjacent the side portion 112. In the exemplary embodiment, the slot 118*a* is spaced apart from the extension 116*a* along the length $L_2$ of the body 102. Alternatively, a slot 118 of one or more of the contact module 22 may be formed within the extension 116 of the same contact module 22. The exemplary extension 116*a* and slot 118*a* have a complementary size and shape to each other because the slots 118 and the extensions 116 of the contact modules 22*a*, 22*b*, and 22*c* have a substantially similar size and shape. However, the extensions 116 of each of the contact modules 22 may have any suitable size and shape that enables the extension 116 to cooperate with the corresponding slot 118, whether or not the extension 116 has the same size and/or shape as the extensions 116 of other contact modules 22 (or other extensions 116 on the same contact module 22). Similarly, the slots 118 of each of the contact modules 22 may have any suitable size and shape that enables the slot 118 to cooperate with the corresponding extension 116, whether or not the slot 118 has the same size and/or shape as the slots 118 of other contact modules 22 (or other slots 118 of the same contact module 22).

Although the contact module 22*a* and the other contact modules 22 illustrated herein each include only one extension 116, each contact module 22 may include any number of extensions 116 for cooperating with any number of slots 118 on adjacent contact modules 22. Similarly, although the contact module 22*a* and the other contact modules 22 illustrated herein each include only one slot 118, each contact module 22 may include any number of slots 118 for cooperating with any number of extensions 116 on adjacent contact modules 22. When a contact module 22 includes more than one extension 116, the extensions 116 may be on the same or different side portions 110 and 112. When a contact module 22 includes more than one slot 118, the slots 118 may be open to the same or different side portions 110 and 112. Although in the exemplary embodiment the slot 118*a* extends completely through the body 102, a slot 118 of one or more of the contact modules 22 may alternatively extend through the side portion 112 and only partially through the body 102 such that the slot 118 does not extend through the side portion 110. In the exemplary embodiment, the slot 118*a* extends through the edge portion 113 of the body 102. Alternatively, a slot 118 of one or more of the contact modules 22 does not extend through the body edge portion 113.

FIG. 6 is a partially exploded perspective view of the electrical connector 10 illustrating the contact modules 22 being mounted in the housing 12. As each contact module 22 is loaded into the housing chamber 26, the extension 116 of each contact module 22 is received within the corresponding slot 118 of the contact module 22 adjacent the side portion 110. For example, the extension 116*a* of the contact module 22*a* is received within the slot 118*b* of the contact module 22*b*, while the extension 116*c* of the contact module 22*c* is received within the slot 118*a* of the contact module 22*a*. The extensions 116 and the slots 118 thereby form lock elements that interlock the contact modules 22 with one another to facilitate stabilizing and securing the contact modules 22 within the housing 12. Because the outermost contact module 22*d* on a side portion 120 of the housing 12 does not have a contact module 22 held adjacent the side portion 110 of the contact module 22*d*, an extension 116*d* of the contact module 22*d* is not received within a slot 118 of a contact module 22. Similarly, because the outermost contact module 22*e* on a side portion 122 of the housing 12 does not have a contact module 22 held adjacent the side portion 112 of the contact module 22*e*, a slot 118*e* of the contact module 22*e* does not receive the extension 116 of a contact module 22. As discussed above, each slot 118 extends through the edge portion 113 of the corresponding contact module body 102. As such, the contact modules 22 can be separately loaded into the housing 12 as shown in FIG. 6.

As can be seen in FIG. 5, adjacent slots 118 and adjacent extensions 116 are spaced apart to facilitate preventing interference between adjacent extensions 116. Specifically, the slot 118 of each contact module 22 is spaced apart from the slot 118 of each contact module 22 that is adjacent thereto along the length $L_2$ of the contact module bodies 102. Similarly, the extension 116 of each contact module 22 is spaced apart from the slot 116 of each contact module 22 that is adjacent thereto along the length $L_2$ of the contact module bodies 102. The electrical connector 10 is not limited to the exemplary pattern of spacing shown in FIG. 6. Rather, adjacent extensions 116 and adjacent slots may have a suitable pattern of spacing that enables the contact modules 22 and the electrical connector 10 to function as described herein.

The embodiments described herein provide an electrical connector having contact modules that are at least partially restrained from movement within a housing of the connector. For example, the embodiments described herein may facilitate preventing buckling and/or instability of the contact modules when the electrical connector is mounted on a circuit board. Moreover, the embodiments described herein may facilitate preventing misalignment of features of the electrical connector that facilitate retaining the electrical connector on the circuit board. The embodiments described herein provide an electrical connector that may cost less and/or be more easily manufactured as compared to at least some known electrical connectors.

Exemplary embodiments are described and/or illustrated herein in detail. The embodiments are not limited to the specific embodiments described herein, but rather, components and/or steps of each embodiment may be utilized independently and separately from other components and/or steps described herein. Each component, and/or each step of one embodiment, can also be used in combination with other components and/or steps of other embodiments. When introducing elements/components/etc. described and/or illustrated herein, the articles "a", "an", "the", "said", and "at least one" are intended to mean that there are one or more of the element(s)/component(s)/etc. The terms "comprising", "including" and "having" are intended to be inclusive and mean that there may be additional element(s)/component(s)/etc. other than the listed element(s)/component(s)/etc. Moreover, the terms "first," "second," and "third," etc. in the claims are used merely as labels, and are not intended to impose numerical requirements on their objects. Further, the limitations of the following claims are not written in means—plus-function format and are not intended to be interpreted based on 35 U.S.C. § 112, sixth paragraph, unless and until such claim limitations expressly use the phrase "means for" followed by a statement of function void of further structure.

While the invention has been described in terms of various specific embodiments, those skilled in the art will recognize that the invention can be practiced with modification within the spirit and scope of the claims.

What is claimed is:

1. A contact module configured to be held by a housing of an electrical connector adjacent two other contact modules, said contact module comprising:

a lead frame comprising at least one electrical lead; and a body over-molded around at least a portion of the lead frame such that the body holds at least a portion of the at least one electrical lead, the body having opposite first and second side portions and an edge portion, the first side portion comprising a first extension, the second side portion comprising a first slot that extends through the edge portion of the body, wherein the first extension is configured to be received within a complementary slot of a first of the two other contact modules, and wherein the first slot is configured to receive a complementary extension of a second of the two other contact modules.

2. The contact module according to claim 1, wherein the first slot extends through both of the first and second side portions.

3. The contact module according to claim 1, wherein the first slot is spaced apart from the first extension along a length of the body.

4. The contact module according to claim 1, wherein the first slot and the first extension have a generally complementary size and shape.

5. The contact module according to claim 1, wherein the edge portion of the body intersects the first and second side portions.

6. The contact module according to claim 1, wherein at least a portion of the body is dielectric.

7. The contact module according to claim 1, wherein the body comprises mating and mounting edge portions, a mating contact extends along the mating edge portion, and a mounting contact extends along the mounting edge portion.

8. An electrical connector comprising:

a housing comprising a dielectric material; and a plurality of contact modules held by the housing, each of the contact modules comprising at least one electrical lead, each of the contact modules comprising a body holding at least a portion of the at least one electrical lead, the body comprising an edge portion, a slot, and an extension, the slot of at least one of the contact module bodies extending though the edge portion of the body, wherein the extension of at least one contact module body is received within the slot of an adjacent contact module body.

9. The electrical connector according to claim 8, wherein each contact module body has opposite first and second side portions, the first side portion comprising the extension, the second side portion comprising the slot.

10. The electrical connector according to claim 8, wherein each contact module body has opposite first and second side portions, the slot extending through both of the first and second side portions.

11. The electrical connector according to claim 8, wherein the slot of each contact module body is spaced apart from the extension along a length of the body.

12. The electrical connector according to claim 8, wherein the slots of each of the contact module bodies have a substantially similar size and shape.

13. The electrical connector according to claim 8, wherein the extensions of each of the contact module bodies have a substantially similar size and shape.

14. The electrical connector according to claim 8, wherein the slot of each contact module body is spaced apart from the slot of each adjacent contact module body along a length of the contact module bodies.

15. The electrical connector according to claim 8, wherein the extension of each contact module body is spaced apart from the extension of each adjacent contact module body along a length of the contact module bodies.

16. The electrical connector according to claim 8, wherein the housing comprises a chamber that receives an end portion of each of the contact modules therein.

17. A contact module assembly comprising:

a plurality of contact modules each comprising at least one electrical lead and a body holding at least a portion of the at least one electrical lead, the body of each of the contact modules comprising a pair of opposite side portions that each face a corresponding adjacent other contact module of the plurality of contact modules, the body of each of the contact modules comprising an edge portion that intersects each of the side portions, the plurality of contact modules each comprising lock elements located along the side portions of the body and positioned to interlock with the lock elements of adjacent contact modules, wherein the lock elements comprise a slot that extends through the edge portion of a corresponding one of the contact module bodies.

18. The contact module assembly according to claim 17, wherein the lock elements comprise a plurality of the slots and a plurality of extensions that cooperate with the slots.

19. The contact module assembly according to claim 17, wherein the lock elements comprise a plurality of the slots and a plurality of extensions that interlock with the slots, the body of each contact module comprising at least one of the slots and at least one of the extensions.

20. The contact module assembly according to claim 17, wherein the lock elements comprise a plurality of the slots and a plurality of extensions that interlock with the slots, and the pair of opposite side portions of the body of each contact module are first and second side portions, the first side portion of the body of each contact module comprising at least one of the extensions, the second side portion of the body of each contact module comprising at least one of the slots.

21. The contact module assembly according to claim 17, wherein the lock elements comprise a plurality of the slots and a plurality of extensions that interlock with the slots, each slot extending completely through a portion of the body of the corresponding contact module.

* * * * *